US006531817B1

(12) United States Patent
Holtslag et al.

(10) Patent No.: US 6,531,817 B1
(45) Date of Patent: Mar. 11, 2003

(54) IMAGE DISPLAY PANEL UTILIZING A CYLINDRICAL LENS ARRAY

(75) Inventors: Antonius H. M. Holtslag, Eindhoven (NL); Siebe Tjerk De Zwart, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 09/469,882

(22) Filed: Dec. 22, 1999

(30) Foreign Application Priority Data

Dec. 24, 1998 (EP) ..... 98204429

(51) Int. Cl.[7] ..... H01J 17/49

(52) U.S. Cl. ..... 313/582; 313/586; 313/587; 313/489

(58) Field of Search ..... 313/586, 587, 313/582, 489, 589, 585, 3

(56) References Cited

U.S. PATENT DOCUMENTS 5,640,068 A * 6/1997 Ameniya ..... 313/582
5,939,826 A * 8/1999 Ohsawa et al. ..... 313/582
6,072,279 A * 6/2000 Shino et al. ..... 315/169.4

FOREIGN PATENT DOCUMENTS

DE 3016810 2/1982 ..... G02B/21/62
JP 406020607 A * 6/1994 ..... 313/582
JP 408138559 A * 5/1996

OTHER PUBLICATIONS

"Plasma Display Panels", by T. Shinoda in Optoelectronics, Devices and Technologies, vol. 7, No. 2, pp. 231–251, Dec. 1992.

"Full–Color Fluorescent Display Devices Using a Near–UV Light–Emitting Diode" by Yuchi Sato Nobuyuki Takahashi and Susumu Sato, Jpn. J. Appl. Phys. vol. 35 (1996), pp. L838–839.

* cited by examiner

*Primary Examiner*—Ashok Patel
*Assistant Examiner*—Glenn Zimmerman

(57) ABSTRACT

An image display panel includes a number of channels extending in a first direction. First electrodes extend parallel to the channels and a pair of second electrodes extend perpendicular to the channels. An image cell is created at the position where the pair of second electrodes cross a crossing of a first electrode. An array of cylindrical lenses is arranged on the viewer's side of the panel each having a longitudinal axis substantially parallel to the second electrodes. The pitch of the lens array may be equal to the vertical pitch of the image cells, while the array is shifted with respect to the image cells in a direction substantially perpendicular to the second electrodes. Also, the pitch of the lens array may be smaller than the vertical pitch of the image cells with or without with the aforementioned shift of the lenses with respect to the image cells.

7 Claims, 3 Drawing Sheets

IMAGE DISPLAY PANEL UTILIZING A CYLINDRICAL LENS ARRAY

BACKGROUND OF THE INVENTION

Image display panels for displaying monochromatic images or color images comprise plasma display panels (PDP). Panels of this type are used, for example, as displays for televisions and computer applications. In a plasma display panel, the plasma generates UV radiation exciting electroluminescent phosphors. The luminous flux of such a panel is substantially isotropic.

An image display panel of the type described in the opening paragraph is known from, for example, German Offenlegungsschrift DE 3016810. The image display panel described herein is provided with an array of cylindrical lenses situated at the area of a row of discharge pixels of the panel on the viewer's side of the panel. The light rays coming from the image display panel are concentrated within a given viewing angle perpendicular to the image display panel. In addition to a sufficient brightness of the image display panel, it is important that the light emitted by the image display panel also falls within the correct viewing angle. A correct viewing angle is understood to mean the viewing angle within which the viewers are present. Light falling outside this viewing angle is thus lost to the viewers.

In the known image display panel, there is one cylindrical lens per row of discharge pixels, and the axis of the cylindrical lens is situated above the center of the corresponding row of discharge pixels.

A drawback in this case is that the light will be concentrated right in front of the image display panel. Dependent on the use of the panel and, consequently, on the viewer's position with respect to this panel, the viewer will observe an uneven distribution of the intensity across the image.

OBJECTS AND SUMMARY OF THE INVENTION

It is an object of the present invention to provide an image display panel having a viewing angle which is limited in size but is sufficiently large, and in which the intensity variation across the image is considerably reduced for the viewer.

According to the invention, the image display panel, in which the pitch of the cylindrical lens array is equal to the pitch of the image cells, is therefore characterized in that the cylindrical lens array is shifted with respect to the image cells in a direction substantially perpendicular to the second electrodes.

By shifting the cylindrical lens array in said direction with respect to the row of discharge pixels, the viewing angle will be spatially shifted. In fact, in many applications, a viewer is not present right in front of the image display panel but slightly lower than the panel. This applies both to domestic use and to uses of large screens in public establishments. Due to the above-mentioned measure, the viewing angle limited by the cylindrical lens array is spatially shifted. For example, a shift such that the image reaches the image display panel at an angle of 15° to 20° with respect to the direction perpendicular to this panel yields an image having a much higher light intensity within the relevant viewing angle for the viewer as compared with the case where the cylindrical lenses are present exactly above the rows of discharge pixels.

Another embodiment of the image display panel according to the invention is characterized in that the cylindrical lens array has a smaller pitch than the image cells.

The pitch of the image cells is understood to mean the vertical pitch when the image display panel is in use.

By adapting the pitch of the cylindrical lens array, the distance to the panel on which the brightness and light homogeneity of the image is optimal can be adapted. The size of the pitch of the cylindrical lens array defines this distance.

A preferred embodiment of the image display panel according to the invention is characterized in that the cylindrical lens array is shifted with respect to the image cells in a direction substantially perpendicular to the second electrodes.

By shifting both the cylindrical lens array with respect to the rows of discharge pixels and making the pitch of the cylindrical lenses smaller than the pitch between the discharge pixels, the light rays coming from the image display panel can be directed and the light intensity can be concentrated. In this way, the light intensity will be relatively high for the viewers and the intensity variation across the image display panel is reduced to a minimum.

A further embodiment of the image display panel according to the invention is characterized in that the cylindrical lens array is implemented as a separate element, with the cylindrical lens structure facing the image display panel. In addition to the optical shift, the array may also play the role of a protective plate for the panel if mechanical defects should occur. When, moreover, the lens structure faces the image display panel, the lens structure is prevented from being contaminated by, inter alia, dust and fingerprints. In this case, the outer side of the panel may be a smooth surface which may also be provided with coatings in a relatively simple way.

Another embodiment of the image display panel according to the invention is characterized in that the cylindrical lens array is provided on a side of the first substrate facing the image display panel.

This has the advantage that the cylindrical lens array does not need to be implemented as a separate element in this case but forms part of the glass plate used as a substrate.

A further embodiment of the image display panel according to the invention is characterized in that light-absorbing material is provided between the cylindrical lens array and the image display panel at the area of the boundary faces between two successive cylindrical lenses.

By providing light-absorbing material at the area of the boundary face of two successive cylindrical lenses, for example, in the form of black lines, Moiré interference between the lens structure and the cell structure is prevented. Moreover, the contrast is enhanced because a part of the incident ambient light will be absorbed by the line pattern.

A further embodiment of the image display panel according to the invention is characterized in that the cylindrical lenses are implemented as Fresnel lenses.

A Fresnel structure has the advantage that it can be replicated in a relatively simple manner.

These and other aspects of the invention are apparent from and will be elucidated with reference to the embodiments described hereinafter.

DESCRIPTION OF THE PREFERRED EMBODIMENTS

Figure 1:
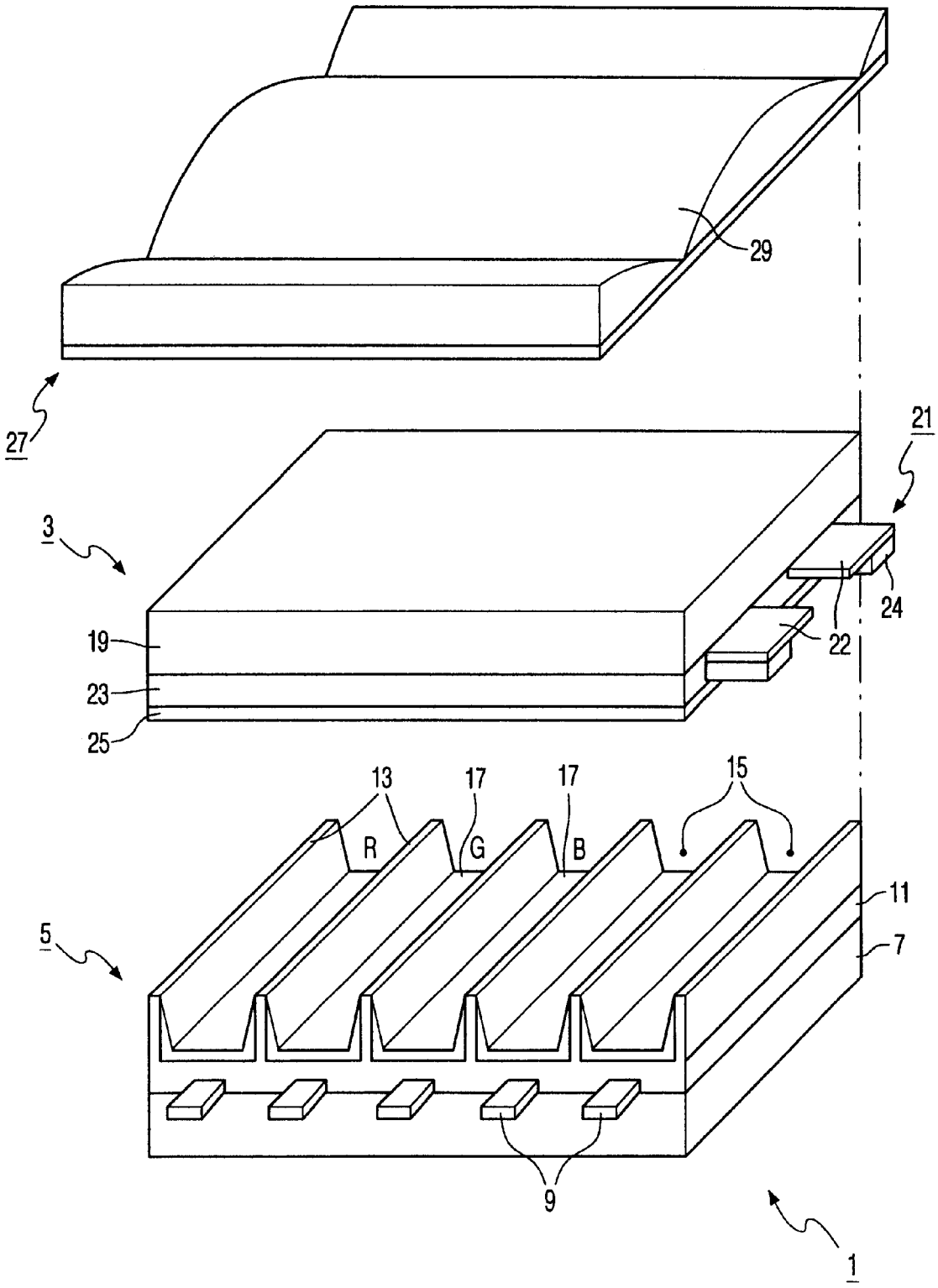
FIG. 1 is a perspective view of an embodiment of an image display panel according to the invention.

The embodiment of an image display panel 1, shown in a perspective view in FIG. 1, comprises a front plate 3 and a rear plate 5. The rear plate 5 comprises a first substrate 7 on which first electrodes 9 are provided. These are referred to as the address electrodes ensuring that the cells of the image display panel are addressed. A dielectric layer 11 is provided across these electrodes. This layer 11 is provided with parallel ribs 13 jointly constituting a channel structure. The ribs have the function of preventing crosstalk between neighboring cells. The channels 15 thus formed are parallel to the first electrodes 9. The number of electrodes 9 corresponds to the number of channels 15. Each channel is provided with a phosphor layer 17. The front plate 3 comprises a second substrate 19. Second electrodes 21 are provided in pairs on the substrate 19. These are referred to as the sustain electrodes ensuring that the discharge of the addressed cell is maintained. The second electrodes 21 comprise a first layer 22 of a transparent material such as, for example, ITO, and a second layer 24, for example, a metal electrode. The second electrodes 21 are situated in a direction substantially transverse to the first electrodes 9. Subsequently, a dielectric layer 23 and a protective layer 25 of, for example, MgO are provided on the substrate 19.

In the embodiment shown, the address electrodes and the sustain electrodes are situated on the facing substrates. Other embodiments are also possible, in which the first and the second electrodes are present on the same substrate. Examples are described in the article "Plasma display panels" by T. Shinoda in Optoelectronics, Devices and Technologies, Vol. 7, No. 2, pp. 231–251, December 1992.

The front plate 3 and the rear plate 5 are subsequently assembled together so that a cavity is formed which is filled with an ionizable gas mixture. The image is observed on the front plate 3 of the image display panel. When the image display panel is operative, a discharge pixel or image cell is formed at the location of the crossing of a first electrode 9 and the space between a pair of second electrodes 21 by selective ionization of the ionizable gas in the channels.

In the present invention, the image display panel is provided with an array 27 of cylindrical lenses 29 on the viewer's side in such a way that the viewing angle limited by the cylindrical lenses, and also the concentration of the light intensity, are spatially controllable. Spatially is understood to mean in height with respect to the direction perpendicular to the image display panel or in distance to the image display panel.

FIGS. 2, 3, 4 and 5 are side-elevational views of the positions of the cylindrical lens array with respect to the image display panel. In these Figures, the discharge space is not shown in detail but by means of a block denoted by reference numeral 20.

Figure 2:
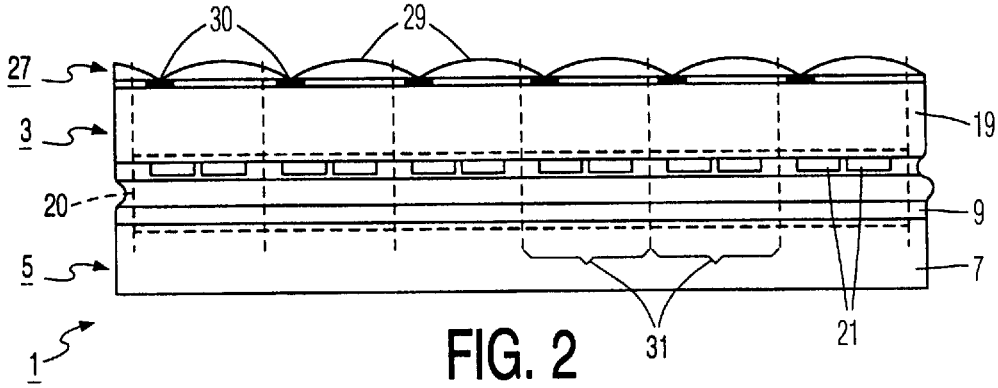
FIG. 2 is a side-elevational view of a first embodiment of an image display panel according to the invention, in which the cylindrical lens array is shifted with respect to the rows of discharge pixels.

In FIG. 2, the cylindrical lenses 29 have the same pitch 30 as the image cells 31 of the image display panel, but the cylindrical lens array 27 is shifted with respect to the image cells in a direction substantially perpendicular to the second electrodes 21. The pitch of the image cells is herein understood to mean the pitch in the vertical direction when the image display panel is in use. It is thereby achieved that the realized viewing angle limited by the cylindrical lenses 29 is shifted in height with respect to the direction perpendicular to the image display panel. In fact, in most applications, the viewer is not present right in front of the image display panel but slightly lower than the panel. When the viewing angle is offset in that direction by shifting the cylindrical lens array, the light rays coming from the image display panel are directed preferentially. Consequently, the viewer will be able to observe a considerably higher light intensity. The extent of shift of the cylindrical lens array 27 with respect to the image cells 31 defines the magnitude of the offset of the viewing angle in height with respect to the direction perpendicular to the image display panel.

Figure 3:
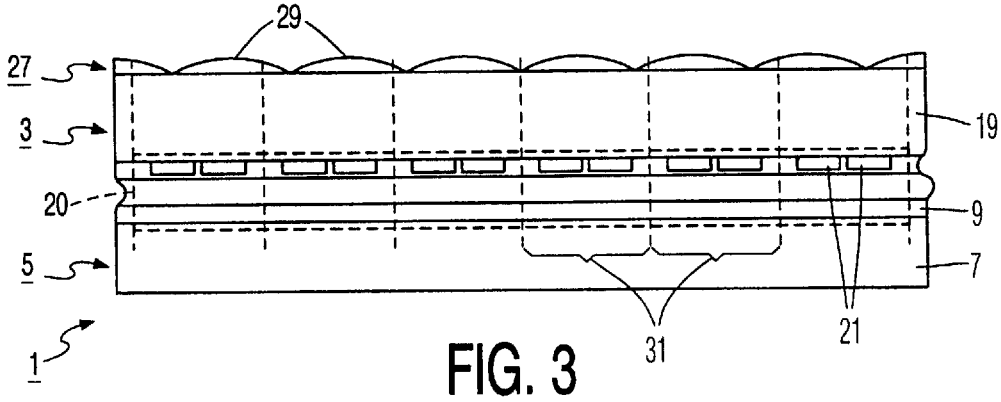
FIG. 3 is a side-elevational view of a second embodiment of an image display panel according to the invention, in which the pitch of the cylindrical lens array is smaller than the pitch of the discharge pixels.

FIG. 3 is a side-elevational view of a second embodiment of an image display panel according to the invention. In this case, the pitch of the cylindrical lens array 29 is smaller than the pitch of the image cells 31. It is thereby achieved that the light intensity from the image display panel is concentrated at a given distance from the image display panel. This distance is determined by the pitch of the cylindrical lens array. The concentration of the light intensity is particularly advantageous in applications in which the distance between the viewers and the image display panel is relatively small. The larger the distance to the image display panel, the smaller the need for concentrating the light intensity.

In a preferred embodiment of the image display panel according to the invention, the pitch of the cylindrical lens array 27 is smaller than the vertical pitch of the image cells 31, and the cylindrical lens array 27 is also shifted with respect to the image cells 31. It is thereby possible to direct the light rays from the image display panel and concentrate the light intensity.

Figure 4:
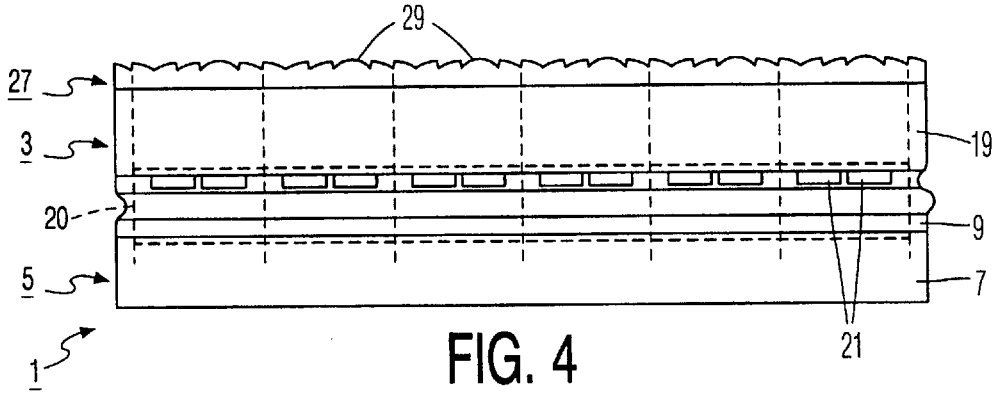
FIG. 4 is a side-elevational view of an embodiment of an image display panel according to the invention, in which the cylindrical lenses are implemented as Fresnel lenses.
Figure 5:
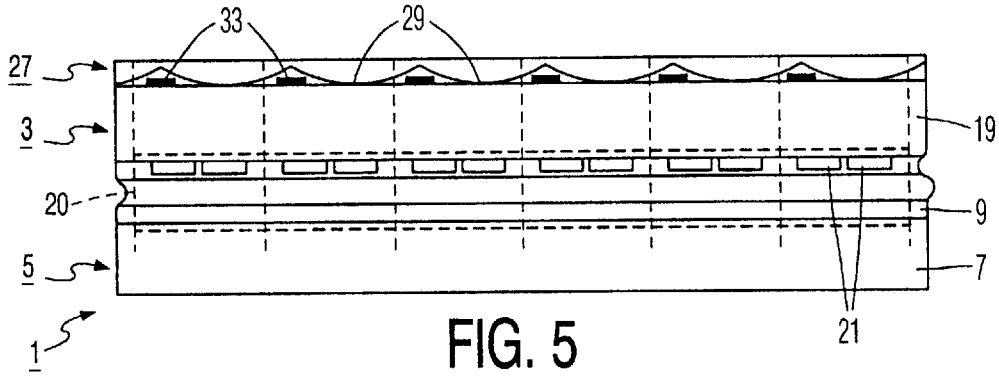
FIG. 5 is a side-elevational view of an embodiment of an image display panel according to the invention, in which the lens structure faces the image display panel.

FIG. 4 shows an embodiment of an image display panel according to the invention in which the cylindrical lenses are implemented as Fresnel lenses. Fresnel lenses can be replicated relatively easily as compared with cylindrical lenses having a smooth lens surface. In the example shown, the Fresnel lenses are only shifted with respect to the image cells. It is of course also possible to make the pitch of the array of Fresnel lenses smaller than the vertical pitch of the image cells. To prevent Moiré interference, it is advantageous to provide light-absorbing material at the area of the boundary faces between two successive cylindrical lenses, also when these are implemented as Fresnel lenses. This may be done, for example, by providing a black line pattern on the side of the second substrate facing the viewer. The pitch between the lines 33 corresponds to the pitch of the array 27. An example is shown in FIGS. 2 and 5 but is of course applicable in all embodiments. A further advantage of the presence of the light-absorbing material is a considerable improvement of the contrast. In fact, ambient light incident on the panel is partly absorbed by this line pattern. The cylindrical lens array 27 may be provided as a separate element on the image display panel, for example, in the form of a foil. The lens structure is then preferably directed towards the image display panel, as shown in FIG. 5 for example. In this way, the structure is prevented from being contaminated by dust or fingerprints and the risk of damage is reduced. A further advantage is that a smooth surface on which coatings can be provided in a relatively easy way is obtained on that side of the complete image display panel 1 which faces the viewer.

Instead of providing the cylindrical lens array as a separate element, it may be provided, for example, by means of replica techniques or sandblasting on the side of the second substrate 19 facing the image display panel. In this way, damage or contamination is also prevented and, moreover, there is no extra optical element.

Figure 6A:
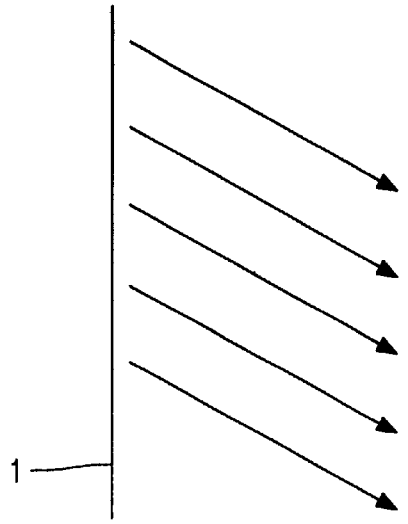
FIGS. 6*a*, 6*b* and 6*c* show the way in which the light rays are spatially directed and the light intensity is spatially concentrated in accordance with some of the different embodiments.
Figure 6B:
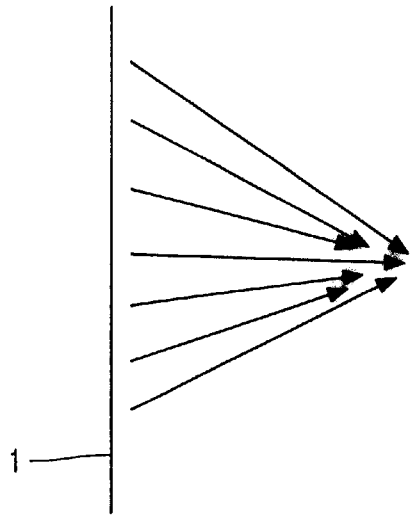
Figure 6C:
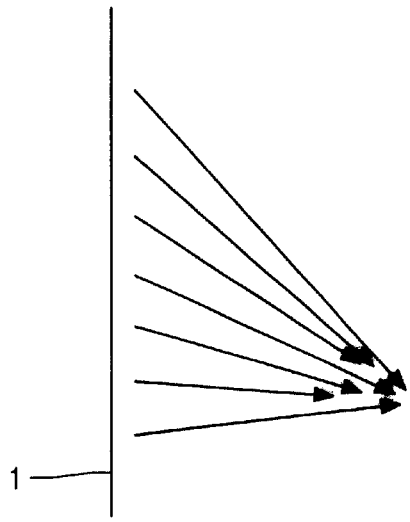

FIG. 6 illustrates, for some embodiments, the direction in which the light rays coming from the image display panel are directed and where the light intensity of the image is concentrated. FIG. 6*a* shows the situation in which the cylindrical lens array 27 is shifted with respect to the image cells 31 in a direction perpendicular to the second electrodes 21, the array 27 and the image cells 31 having the same pitch. FIG. 6*b* applies to the situation in which the pitch of the cylindrical lens array 27 is smaller than the vertical pitch of the image cells 31. In FIG. 6*c*, the pitch of the cylindrical lens array 27 is smaller than the vertical pitch of the image cells 31, and the cylindrical lens array 27 is shifted with respect to the image cells 31 in a direction substantially perpendicular to the second electrodes 21.

The pitch of the image cells 31 referred to in the different embodiments is the pitch of the image cells in the vertical direction when the image display panel is in use, which is also referred to as vertical pitch.

The shift of the cylindrical lens array 27 with respect to the image cells 31 is always understood to mean a shift in a direction substantially perpendicular to the direction in which the second electrodes 21 extend.

What is claimed is:

1. An image display panel comprising a first substrate and a second substrate, with at least a plurality of channels extending on the first substrate in the first direction and comprising an ionizable gas, first electrodes being situated parallel to the channel, the image display panel further comprising at least a plurality of pairs of second electrodes which extend in a second direction substantially transverse to the first direction, while, in operation, an image cell is created between a pair of the second electrodes at the location of the crossing first electrode by selective ionization of the ionizable gas in the channels, and a cylindrical lens array is situated on the viewer's side of the image display panel, the longitudinal axis of the cylindrical lenses extending substantially parallel to the second electrodes, and the pitch of the cylindrical lens array being equal to the pitch of the image cells, characterized in that the cylindrical lens array is shifted with respect to the image cells in a direction substantially perpendicular to the second electrodes.

2. An image display panel as claimed in claim 1, characterized in that the cylindrical lens array is implemented as a separate element having cylindrical lens structure facing the image display panel.

3. An image display panel as claimed in claim 1, characterized in that the cylindrical lens array is provided in a side of the first substrate facing the image display panel.

4. An image display panel as claimed in claim 1, characterized in that light-absorbing material is provided between the cylindrical lens array and the image display panel at the area of the boundary faces between two successive cylindrical lenses.

5. An image display panel as claimed in claim 1, characterized in that the cylindrical lenses are implemented as Fresnel lenses.

6. An image display panel comprising a first substrate and a second substrate, with at least a plurality of channels extending on the first substrate in the first direction and comprising an ionizable gas, first electrodes being situated parallel to the channel, the image display panel further comprising at least a plurality of pairs of second electrodes which extend in a second direction substantially transverse to the first direction, while, in operation, an image cell is created between a pair of second electrodes at the location of the crossing first electrode by selective ionization of the ionizable gas in the channels, and a cylindrical lens is situated on the viewer's side of the image display panel, the longitudinal axis of the cylindrical lenses extending substantially parallel to the second electrodes, characterized in that the cylindrical lens array has a smaller pitch than the image cells.

7. An image display panel as claimed in claim 6, characterized in that the cylindrical lens array is shifted with respect to the image cells in a direction substantially perpendicular to the second electrodes.

* * * * *